US008408223B2

(12) United States Patent
Brown

(10) Patent No.: US 8,408,223 B2
(45) Date of Patent: Apr. 2, 2013

(54) REMOVABLE SANITARY COVER FOR CANES, WALKERS, CRUTCHES, AND THE LIKE

(76) Inventor: Lemmell F. Brown, McKenna, WA (US)

( * ) Notice: Subject to any disclaimer, the term of this patent is extended or adjusted under 35 U.S.C. 154(b) by 116 days.

(21) Appl. No.: 12/833,558

(22) Filed: Jul. 9, 2010

(65) Prior Publication Data

US 2012/0006368 A1 Jan. 12, 2012

(51) Int. Cl.
*A45B 3/00* (2006.01)
*A45B 9/04* (2006.01)

(52) U.S. Cl. ..... 135/66; 135/65; 135/77

(58) Field of Classification Search ..... 135/65, 135/66, 77, 78, 86; 16/42 R, 42 T, 18 CG
See application file for complete search history.

(56) References Cited

U.S. PATENT DOCUMENTS

| | | | | |
|---|---|---|---|---|
| 3,993,163 | A * | 11/1976 | Barrett | 182/108 |
| 4,027,687 | A | 6/1977 | McGowan | |
| 4,598,485 | A * | 7/1986 | Joe et al. | 36/7.2 |
| 4,800,910 | A * | 1/1989 | Gamm | 135/67 |
| 4,899,771 | A | 2/1990 | Wilkinson | |
| 4,964,430 | A | 10/1990 | Janis | |
| 5,992,434 | A | 11/1999 | Berlin et al. | |
| 6,418,951 | B1 | 7/2002 | Douglass | |
| 6,874,253 | B2 * | 4/2005 | Hollis-Lorent | 36/9 R |
| 7,108,102 | B2 * | 9/2006 | Woodward | 182/108 |
| 7,159,830 | B2 | 1/2007 | Frank et al. | |
| 7,377,662 | B1 | 5/2008 | Bernstein et al. | |
| D572,899 | S | 7/2008 | Berry | |
| D595,501 | S | 7/2009 | Sawada | |
| 7,644,719 | B2 | 1/2010 | Galanty | |
| 7,681,849 | B2 | 3/2010 | Frank et al. | |
| 8,181,923 | B2 * | 5/2012 | Verdelli, Jr. | 248/188.9 |
| 2003/0226585 | A1 * | 12/2003 | Burchel | 135/77 |
| 2004/0088821 | A1 * | 5/2004 | Imperato | 16/18 CG |
| 2008/0116331 | A1 * | 5/2008 | Deaner | 248/188.9 |
| 2008/0209686 | A1 * | 9/2008 | Lang | 16/42 T |
| 2010/0071166 | A1 * | 3/2010 | Klugh et al. | 16/42 R |

* cited by examiner

*Primary Examiner* — David Dunn
*Assistant Examiner* — Danielle Jackson
(74) *Attorney, Agent, or Firm* — Graham & Dunn PC; Kathleen T. Petrich

(57) ABSTRACT

A removable sanitary cover for a leg extremity of a cane, walker, crutch, and the like, to reduce dirt and contaminants coming into from outdoors or dirty environment into an indoor or sanitary area. The sanitary cover includes a base and at least one sidewall that together form an enclosure having an opening generally opposite of the base. The sanitary cover also includes a closure positioned generally circumferentially about the enclosure at the at least one sidewall near the opening. In use, the sanitary cover is positioned about a distal end of the leg extremity of the cane, walker, crutch, and the like, with the closure keeping the sanitary cover in place relative to leg extremity until the sanitary cover is removed through an external force. The closure may be an elastic band, drawstring or other closure means. An optional skid-resistant material may be added or otherwise incorporated into an outer surface of the base.

8 Claims, 3 Drawing Sheets

REMOVABLE SANITARY COVER FOR CANES, WALKERS, CRUTCHES, AND THE LIKE

TECHNICAL FIELD

The present invention relates to sanitary covers for canes, walkers, crutches, and other objects having a leg extremity. More particularly the present invention relates to a removable sanitary cover having an enclosure that is adaptable to a leg extremity and is held in place with a closure or other closure means.

BACKGROUND OF THE INVENTION

Canes, walkers, and crutches are a necessary tool for many people with injuries or limited mobility. People shift their weight to the cane, walker, or crutch in order to walk of their own volition or use the cane, walker or crutch to provide extra stability. Oftentimes, such canes, walkers, and crutches become as indispensable to the user as other aids, such as eyeglasses. Thus, many users would never think to go outside without his or her cane (etc.). But going outdoors with a cane or other piece of mobility assistance equipment can mean picking up dirt, and contaminants and tracking such dirt and contaminants throughout the user's house or indoor environment. Further such tracked in dirt can be even more problematic for someone with an injury or limited mobility because the ability to keep the house clean may be compromised.

SUMMARY OF THE INVENTION

The present invention is directed to apparatus of removable sanitary cover to cover a distal end of a leg extremity of a cane, walker, crutch, and the like and a method of use for same. The sanitary cover includes at least one sidewall and a base that together form an enclosure with an opening generally opposite the base. A closure, such as an elastic band or drawstring, or other closure means, is positioned generally circumferentially about the enclosure at the at least one sidewall near the opening and is capable of keeping the enclosure about the distal end of the leg extremity until an external force removes the sanitary cover from the leg extremity.

The method of using the present invention allows a user to reduce contaminants into a particular area by keep the distal end of the leg extremity of a cane, walker, or crutch (and the like) covered in one type environment (e.g., indoors) and removing it when moving to a different environment (e.g., outdoors). In this way the distal end is kept reasonably clean when applying a freshly washed or new sanitary cover to the leg extremity.

In one embodiment of the invention, the sanitary cover may also include a skid-resistant surface applied to the base to provide more support to the user.

In another embodiment, the sanitary cover may include space for a logo or other indicia.

These and other advantages will become more apparent upon review of the Drawings, the Detailed Description of the Invention, and the Claims.

BRIEF DESCRIPTION OF THE DRAWINGS

Like reference numerals are used to designate like parts throughout the several views of the drawings, wherein.

DETAILED DESCRIPTION OF THE INVENTION

Figure 1:
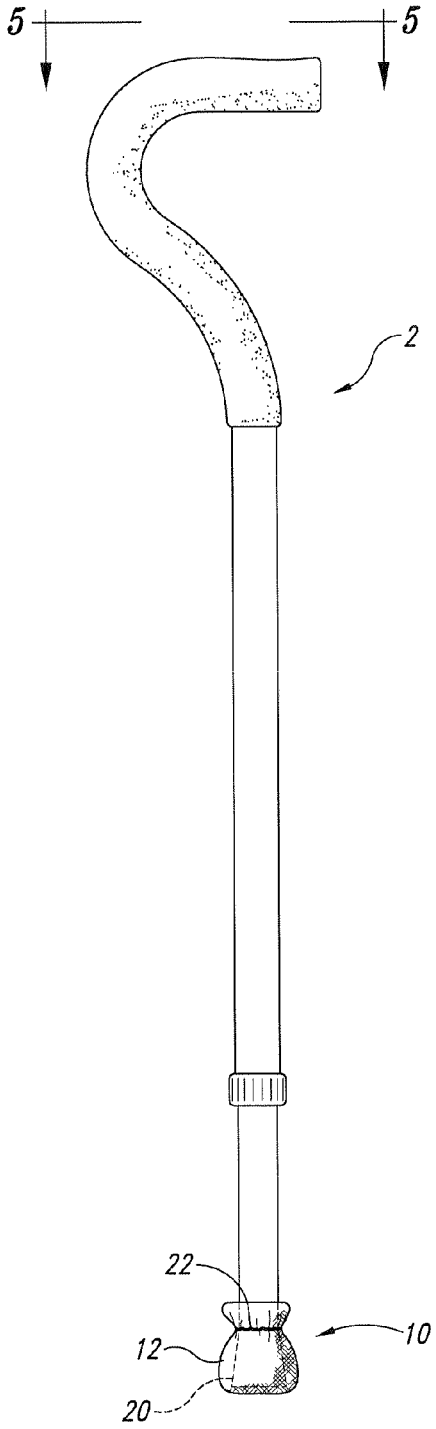
FIG. 1 is a perspective view of a typical cane having a leg extremity and illustrating a removable sanitary cover of the present invention banded to a distal end of the leg extremity of the cane.
Figure 2:
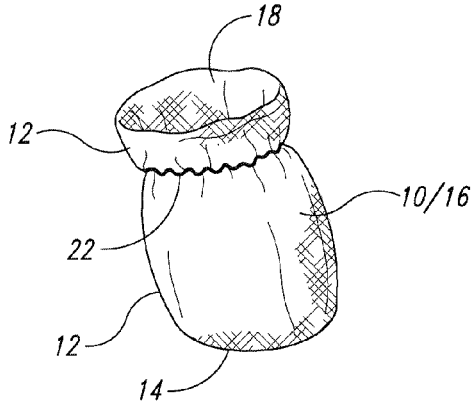
FIG. 2 is an enlarged perspective view of the removable sanitary cover of the present invention having a base and a sidewall forming an enclosure having an opening and a generally circumferential closure about the enclosure at the at least one sidewall near the opening.
Figure 3:
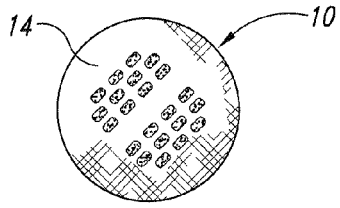
FIG. 3 is a bottom view of the sanitary cover of FIG. 2.
Figure 4:
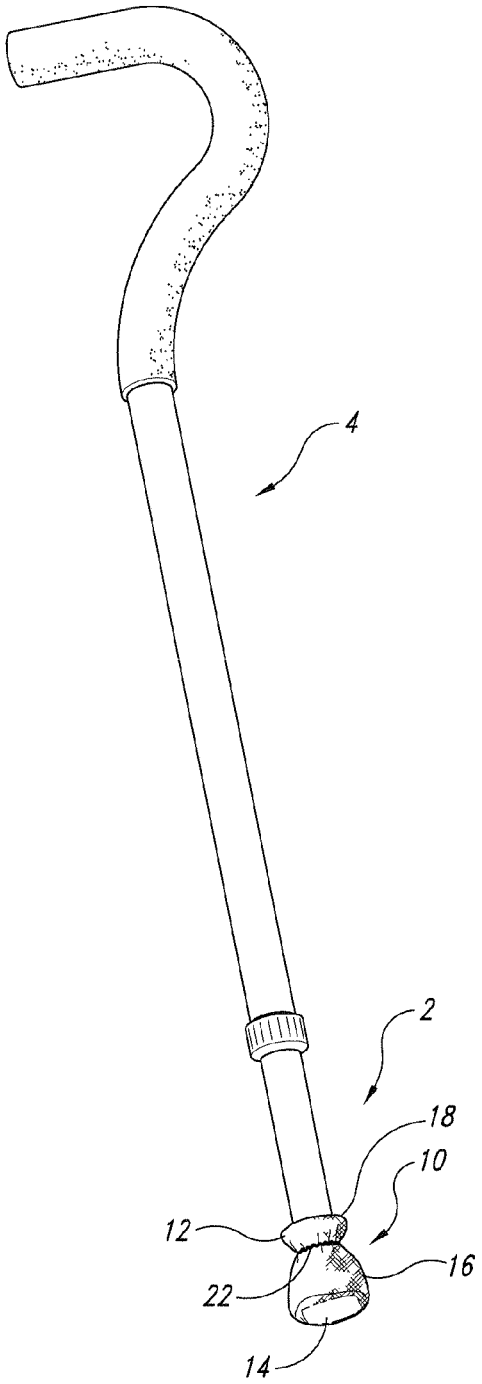
FIG. 4 is a perspective view of the cane and a sanitary cover of a second embodiment and better illustrating an outer surface of the base having a skid resistant surface.
Figure 5:
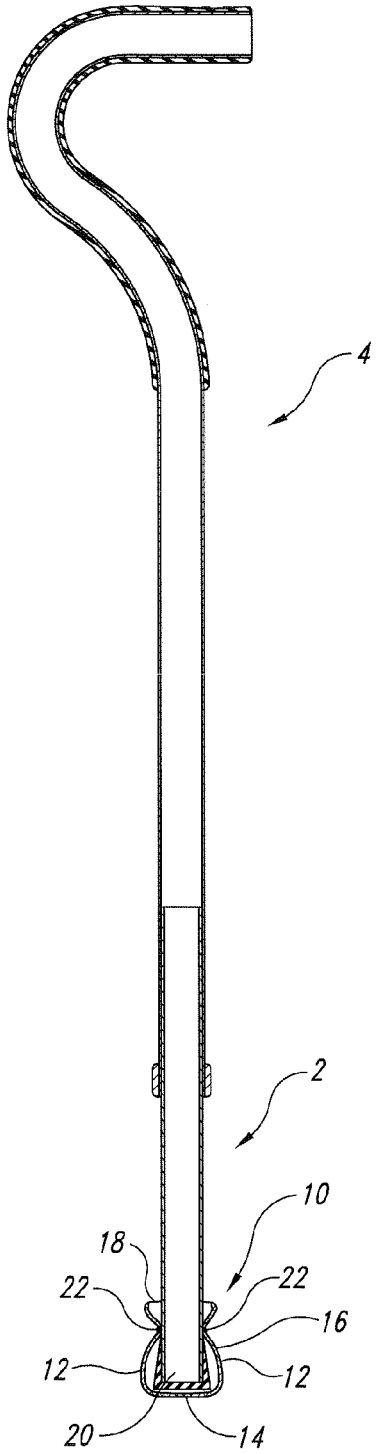
FIG. 5 is a section view taken substantially along lines 5-5 of FIG. 1.
Figure 6:
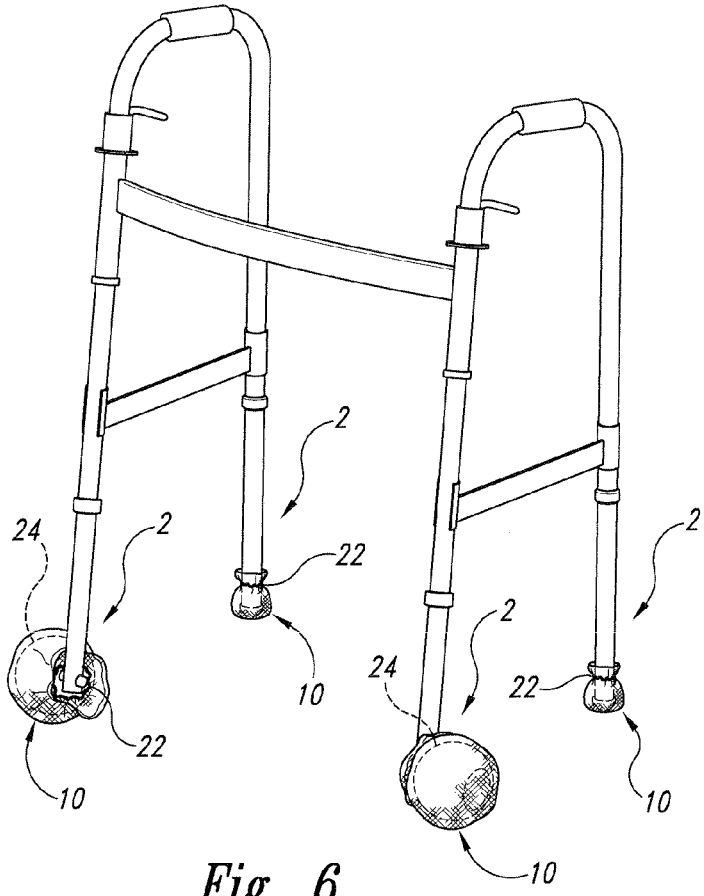
FIG. 6 is a perspective view of a walker having leg extremities and illustrating the application of a sanitary cover for each leg extremity.
Figure 7:
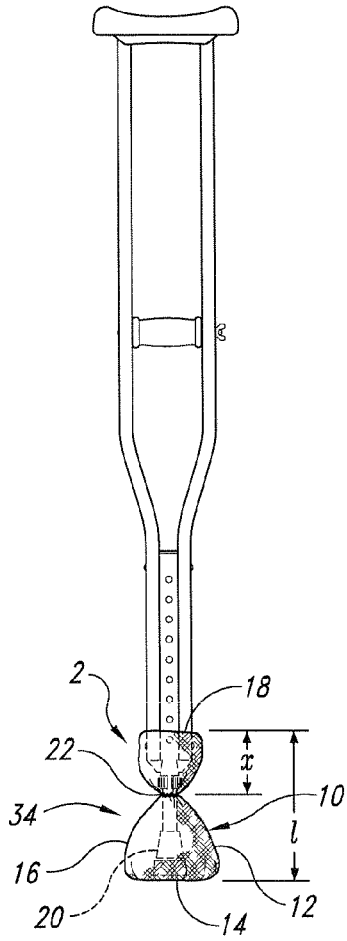
FIG. 7 is a perspective view of a typical crutch having a leg extremity and illustrating a sanitary cover banded to a distal end of the crutch leg extremity.
Figure 8:
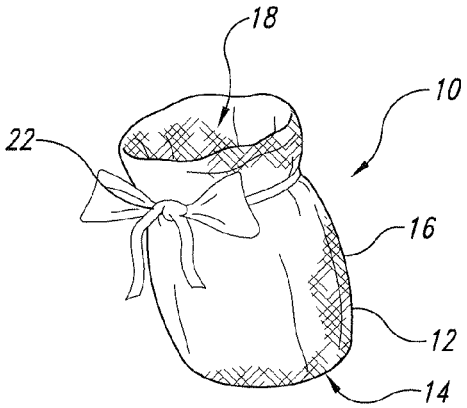
FIG. 8 is a perspective view of the sanitary cover illustrating an alternate closure means.
Figure 9:
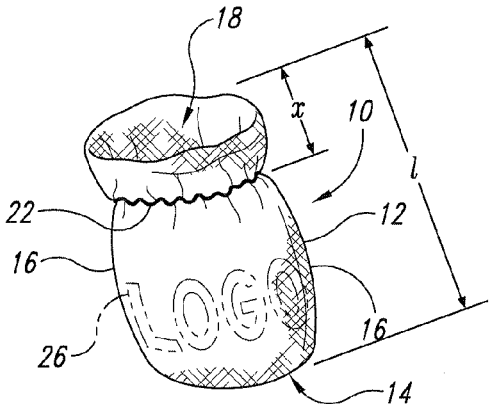
FIG. 9 is a perspective view of a sanitary cover of the present invention in which there is room for a logo or other indicia.

Referring to FIGS. 1-9, the present invention is directed to a removable sanitary cover 10 for a leg extremity 2 of a typical cane 4 (FIGS. 1, 4, 5), walker 6 (FIG. 6), crutch 8 (FIG. 7) or object having a leg extremity such as a chair leg. Sanitary cover 10 includes a sidewall 12 and a base 14 that together form an enclosure 16 having an opening 18 generally opposite of base 14. Enclosure 18 is of a size to receive a distal portion 20 of leg extremity 2. A closure 22, such as an elastic band (FIGS. 1, 2, 6, 7, and 9) or a drawstring (FIG. 8), or other closure means (e.g., snaps, hook and loop fasteners, hook and eye within the sidewall to take up slack of the sidewall) is used to close the enclosure about the leg extremity 2 and for easy removal. Closure 22 is positioned generally circumferentially about enclosure 16 at the at least one sidewall 12 generally near opening 18. As illustrated in FIGS. 5 and 7, the degree of "nearness" or distance "x" to opening 16 is flexible and may be up to ½ of the longitudinal length "1" of the enclosure.

In use, distal end 20 of leg extremity 2 is inserted into the sanitary cover enclosure 16 through opening 18. In most applications, distal end 20 makes contact with sanitary cover base 14, as illustrated in FIGS. 5 and 7. This is because the leg extremities are generally cylindrical with a planar base or other defined bottom surface covering more than a single point. However, some leg extremities/distal ends of walkers may have large spherical shapes 24, such as shown in FIG. 6 that provides greater stability and stress relief. For enlarged spherical shaped leg extremities, the sanitary cover may be placed about the spherical leg extremity with the opening facing outward to the side where the bottom of the spherical leg makes contact with sidewall 12 (FIG. 6). This application is in contrast with enclosure 16 opening up in a generally upward direction for canes (e.g., FIG. 1) and crutches (FIG. 7).

Upon insertion, closure 22 (e.g., elastic band or drawstring or other closure means) keeps sanitary cover 10 in place relative to leg extremity 2 until an external force removes the sanitary cover. In this way, the sanitary cover can be applied to the distal end of a leg extremity when coming indoors (or sanitary area) after the cane, walker, crutch has been outside or in a dirty environment. The invention envisions a method of removing a sanitary cover as described above when the user comes inside or into a sanitary environment. The invention may also include a method to the reverse situation, namely, where the sanitary cover is only used in outdoor or dirty environments and removed for indoor environments.

The cover may be made from cloth material that is preferably washable. According to one aspect of the invention, the material is a stretch cloth. Another aspect of the invention includes where base 14 incorporates a skid resistant material such as that illustrated in FIG. 3 and may be like the non-skid or skid resistant material added to hospital socks.

The sanitary cover may incorporate designs that may be source identifying, such as a logo 26 (FIG. 9) or other indicia, or include more artistic or whimsical design elements (neither illustrated) that may be the subject of a copyright or design patent.

The illustrated embodiments are only examples of the present invention and, therefore, are non-limitive. It is to be understood that many changes in the particular structure, materials, and features of the invention may be made without departing from the spirit and scope of the invention. Therefore, it is the Applicant's intention that her patent rights not be limited by the particular embodiments illustrated and described herein, but rather by the following claims interpreted according to accepted doctrines of claim interpretation, including the Doctrine of Equivalents and Reversal of Parts.

What is claimed is:

1. A method of reducing introduction of contaminants into an indoor environment from users of canes, walkers, and crutches that use such devices indoors and outdoors for the purpose of providing stability in movement or standing, the method comprising:

using the cane, walker, or crutch such that the distal end makes substantially planar contact with an outdoor ground surface that is exposed to contaminants;

providing at least one removable sanitary cover having a base and at least one sidewall that forms an enclosure made from a non rigid material having an opening opposite of the base, wherein the enclosure is of a size and shape to accommodate a distal end of a leg extremity of a cane, walker, or crutch, and said enclosure further including a closure positioned substantially circumferentially about the enclosure at the at least one sidewall near the opening; said base further comprises an outer surface that has skid resistant properties;

covering the distal end of the leg extremity of a cane, walker, or crutch with the sanitary cover such that the base covers the distal end of the leg extremity, which is inserted within the enclosure through its opening when a user brings the cane, walker, or crutch into an indoor environment having been outdoors or in a dirty environment and closing the closure about the distal end prior to entering an indoor location having an indoor ground surface; and using the walker, cane, or crutch such that the covered distal end makes substantially planar contact with the indoor ground surface.

2. The method according to claim 1 wherein the at least one sanitary cover is removed by an external force from the leg extremity when the user takes the cane, walker, or crutch outside or into a dirty environment.

3. The method according to claim 1 wherein the sanitary cover is made of a material that is readily washable when removed from the leg extremity.

4. The method according to claim 1 wherein the sanitary cover closure is an elastic band.

5. The method according to claim 1 wherein the sanitary cover closure is a drawstring.

6. The method according to claim 1 wherein the sanitary cover further comprises an outer surface on the at least one sidewall having space for indicia.

7. A method of reducing introduction of contaminants into an indoor environment from users of canes, walkers, and crutches that use such devices indoors and outdoors for the purpose of providing stability for the users during movement or standing, the method comprising:

providing at least one removable sanitary cover having a base and at least one sidewall that forms an enclosure made from a non-rigid material having an opening opposite of the base, wherein the enclosure is of a size and shape to accommodate a distal end of a leg extremity of a cane, walker, or crutch, and said enclosure further including a closure positioned substantially circumferentially about the enclosure at the at least one sidewall near the opening; and wherein said base has an outer surface having skid resistant properties;

covering the distal end of the leg extremity of a cane, walker, or crutch with the sanitary cover such that the base covers the distal end of the leg extremity, which is inserted within the enclosure through its opening when a user brings the cane, walker, or crutch into an outdoor or dirty environment having been indoors or in a sanitary environment; and closing the closure about the distal end prior to entering an outdoor location having an outside ground surface that is exposed to contaminants; and using the walker, cane, or crutch such that the covered distal end makes substantially planar contact with the outside ground surface.

8. The method according to claim 7 wherein the at least one sanitary cover is removed by an external force from the leg extremity when the user takes the cane, walker, or crutch indoors or into a sanitary environment.

* * * * *